US009744092B2

(12) United States Patent
Fu et al.

(10) Patent No.: US 9,744,092 B2
(45) Date of Patent: Aug. 29, 2017

(54) LIMB REHABILITATION AND TRAINING SYSTEM

(71) Applicant: NATIONAL TAIWAN UNIVERSITY, Taipei (TW)

(72) Inventors: Li-Chen Fu, Taipei (TW); Kai-Wen Lee, Taipei (TW); Yi-Wen Liao, Taipei (TW); Wei-Wen Wang, Taipei (TW); Jin-Shin Lai, Taipei (TW)

(73) Assignee: National Taiwan University, Taipei (TW)

( * ) Notice: Subject to any disclaimer, the term of this patent is extended or adjusted under 35 U.S.C. 154(b) by 414 days.

(21) Appl. No.: 14/082,344

(22) Filed: Nov. 18, 2013

(65) Prior Publication Data

US 2014/0336542 A1 Nov. 13, 2014

(30) Foreign Application Priority Data

May 13, 2013 (TW) ..... 102116941 A

(51) Int. Cl.
*A61H 1/02* (2006.01)

(52) U.S. Cl.
CPC ..... *A61H 1/0281* (2013.01); *A61H 1/0277* (2013.01); *A61H 2201/1659* (2013.01); *A61H 2201/5007* (2013.01); *A61H 2201/5061* (2013.01); *A61H 2201/5092* (2013.01); *A61H 2201/5097* (2013.01)

(58) Field of Classification Search
CPC ..... A61H 1/02; A61H 1/0274; A61H 1/0277; A61H 1/0281
See application file for complete search history.

(56) References Cited

U.S. PATENT DOCUMENTS 4,669,451 A 6/1987 Blauth et al.
5,163,451 A 11/1992 Grellas
5,179,939 A * 1/1993 Donovan ..... A61H 1/0281 482/4

(Continued)

FOREIGN PATENT DOCUMENTS

TW 571731 1/2004
TW M270792 U 7/2005

(Continued)

*Primary Examiner* — Justine Yu
*Assistant Examiner* — Kathrynn Lyddane
(74) *Attorney, Agent, or Firm* — Rosenberg, Klein & Lee

(57) ABSTRACT

A limb rehabilitation and training system includes a horizontal position adjuster movably mounted at a bottom side of a base, an expansion rotary member mounted at the horizontal position adjuster, a shoulder joint traction mechanism linked to the expansion rotary member through a first arm segment robotic arm and a height adjuster, and an upper-limb rehabilitation device linked to the shoulder joint traction mechanism. The upper-limb rehabilitation device is able to rapidly be adjusted to fit the left arm or right arm through the horizontal position adjuster, the expansion rotary member, the first arm segment robotic arm and a shoulder positioning-lifting rotary member and. Further, by means of the shoulder joint traction mechanism, the user's stiffened shoulder joint can be timely moved for a separation distance, achieving the function of loosening the joint and facilitating performance of successive rehabilitation treatment or training.

25 Claims, 9 Drawing Sheets

(56) References Cited

U.S. PATENT DOCUMENTS 5,417,643 A * 5/1995 Taylor ..... A61H 1/0274 601/24
6,301,526 B1 * 10/2001 Kim ..... B25J 9/0006 600/1
6,676,612 B1 1/2004 Beny et al.
6,695,795 B2 * 2/2004 Knoll ..... A61H 1/0281 601/26
7,862,524 B2 1/2011 Carignan et al.
8,834,169 B2 * 9/2014 Reinkensmeyer ... A61H 1/0274 434/247
8,905,950 B2 * 12/2014 Bonutti ..... A61H 1/0237 128/845
8,968,220 B2 * 3/2015 Han ..... A61H 1/0274 601/23
9,017,271 B2 * 4/2015 Nef ..... A61H 1/0281 601/23
2003/0115954 A1 * 6/2003 Zemlyakov ..... A61B 5/022 73/379.01
2007/0255190 A1 * 11/2007 Sadok ..... B25J 9/0006 602/16
2009/0264799 A1 * 10/2009 Bonutti ..... A61H 1/0237 601/5
2009/0281465 A1 11/2009 Fu et al.
2010/0016766 A1 1/2010 Zhang et al.
2010/0249673 A1 9/2010 Nef et al.
2013/0060171 A1 * 3/2013 Fu ..... A61H 1/0274 601/5
2013/0209979 A1 * 8/2013 Mihelj ..... A61B 5/11 434/247
2013/0237883 A1 * 9/2013 Malosio ..... A61H 1/0274 601/33

FOREIGN PATENT DOCUMENTS

TW M333178 U 6/2008
TW M357303 U 5/2009
TW I368502 7/2012

* cited by examiner

LIMB REHABILITATION AND TRAINING SYSTEM

BACKGROUND OF THE INVENTION

1. Technical Field

The present invention relates to physical rehabilitation technology, and more particularly to a limb rehabilitation and training system for use in medical rehabilitation or exercise training.

2. Description of the Prior Art

A conventional limb rehabilitation and training system, as illustrated in FIG. 1, is known. This system is invented by the present invention, and patented in Taiwan under Taiwan Patent No. 1354550, entitled "Rehabilitation and training system and its control method". This design of limb rehabilitation and training system 10 comprises a multi-axis robotic arm 11, a position adjustment mechanism 12, a movable base 13, and a control system 14. The multi-axis robotic arm 11 is a combination of robotic arms having 8 degrees of freedom.

The aforesaid prior art limb rehabilitation and training system 10 uses the multi-axis robotic arm 11 to perform rehabilitation or training exercises, such as lifting, expanding or rotating the user's shoulder/thigh, upper limb/knee joint, forearm/calf, palm/sole or wrist/ankle joint.

The aforesaid prior art limb rehabilitation and training system 10 can achieve remarkable results in helping the user undergo limb rehabilitation or sports training, but there is still room for improvement:

1. After installation, the aforesaid prior art limb rehabilitation and training system 10 can simply be applied to train one single arm of the user, for example, as illustrated, the limb rehabilitation and training system 10 is simply applicable to the user's right arm, not rapidly adjustable for treating the user's left arm, and therefore this design of limb rehabilitation and training system 10 cannot be used in the most efficient way.

2. The multi-axis robotic arm 11 of the limb rehabilitation and training system 10 is disposed close to the back of the user's head, and the user's head can strike the multi-axis robotic arm 11 accidentally when the user expands the shoulders or arms. Thus, the user may feel fear and dare not use the limb rehabilitation and training system 10.

3. The limb rehabilitation and training system 10 must use the front three arm segments of the multi-axis robotic arm to adjust and to position the position of the user's shoulder joint. Thus, the operation is inconvenient. Further, the user's shoulder joint can easily be moved away from the set accurate position during rehabilitation or training exercises, lowering the shoulder joint, elbow joint, wrist joint or arm rehabilitation effects, and resulting in a secondary joint injury.

4. The aforesaid prior art limb rehabilitation and training system 10 does not has means for pulling stiffened joint apart, and thus the important joint mobilization in rehabilitation must be performed by a physiatrist or a physical therapist personally.

SUMMARY OF THE PRESENT INVENTION

It is, therefore, the main object of the present invention to provide a limb rehabilitation and training system, which has a shoulder joint traction mechanism mounted in a multi-axis robotic arm thereof for stretching a stiffened shoulder joint of a user, loosening the shoulder joint and facilitating the performance of successive rehabilitation treatment or training.

It is another object of the present invention to provide a limb rehabilitation and training system, which is adjustable to fit the left arm and/or right arm, not only effectively enhancing the efficiency of use of the limb rehabilitation and training system but also saving resources.

It is still another object of the present invention to provide a limb rehabilitation and training system, which has the multi-axis robotic arm thereof kept away from the user's head to prevent accidental head injury during a rehabilitation or training operation, increasing user's interest in using the limb rehabilitation and training system.

It is still another object of the present invention to provide a limb rehabilitation and training system, which uses localized video recorder, position sensors and/or locate points to ensure accurate positioning of the upper-limb rehabilitation device and every arm segment robotic arm, avoiding accidental joint injury during the rehabilitation treatment or training.

To achieve these and other objectives of the present invention, the present invention provides a limb rehabilitation and training system, comprising: a first arm segment robotic arm comprising a vertical bar and a vertical linear guide mounted at the vertical bar, a height adjuster comprising a height positioning slide connected to the vertical linear guide of the first arm segment robotic arm to move along the vertical linear guide; a shoulder joint traction mechanism having one end thereof mounted with one of a shoulder positioning-lifting rotary member and a shoulder positioning member for connecting to the height adjuster, the shoulder joint traction mechanism comprising a traction displacement member therein; and an upper-limb rehabilitation device comprising an upper arm positioning-lifting rotary member having one end thereof connected to the traction displacement member, and a simple support or a multi-axis robotic arm connected to an opposite end of the upper arm positioning-lifting rotary member opposite, the upper arm positioning-lifting rotary member being movable by the traction displacement member for a separation distance.

The present invention provides another limb rehabilitation and training system, comprising: a horizontal position adjuster comprising a horizontal linear guide and a horizontal positioning slide linked to the horizontal linear guide; a first arm segment robotic arm comprising a horizontal bar and a vertical bar having one end thereof connected to the horizontal bar, a vertical linear guide mounted at the vertical bar, and an expansion rotary member mounted at the vertical bar, the expansion rotary member being linkable to the horizontal positioning slide for enabling the first arm segment robotic arm to be rotated left and right on the horizontal positioning slide; a height adjuster comprising a height positioning slide connected to the vertical linear guide of the first arm segment robotic arm; and an upper-limb rehabilitation device comprising a upper arm positioning-lifting rotary member and a simple support or a multi-axis robotic arm linked to one end of the upper arm positioning-lifting rotary member, the upper arm positioning-lifting rotary member having an opposite end thereof linked to the height adjuster and adapted for rotating the linked the simple support or the multi-axis robotic arm up and down.

In one embodiment of the limb rehabilitation and training system, the traction displacement member is selectively made in the form of a traction displacement actuator or traction displacement manual manipulator.

In one embodiment of the limb rehabilitation and training system, the height adjuster further comprises a shoulder joint traction positioning guide located at an extended location or back side of the height positioning slide for connecting the shoulder positioning-lifting rotary member of the shoulder joint traction mechanism and allowing the shoulder positioning-lifting rotary member to be moved or rotated on the shoulder joint traction positioning guide.

In one embodiment of the limb rehabilitation and training system, further comprises: a horizontal position adjuster comprising a horizontal linear guide and a horizontal positioning slide linked to the horizontal linear guide; and the first arm segment robotic arm comprising a horizontal bar having one end thereof connected to the vertical bar, and an expansion rotary member mounted at an opposite end of the horizontal bar and connectable to the horizontal positioning slide for enabling the first arm segment robotic arm to be rotated leftward and rightward on the horizontal positioning slide.

In one embodiment of the limb rehabilitation and training system, further comprises: a horizontal position adjuster comprising a horizontal linear guide and a horizontal positioning slide linked to the horizontal linear guide; and the first arm segment robotic arm comprising a horizontal bar having one end thereof connected to the vertical bar, and an expansion rotary member mounted at an opposite end of the horizontal bar and connectable to the horizontal positioning slide for enabling the first arm segment robotic arm to be rotated leftward and rightward on the horizontal positioning slide.

In one embodiment of the limb rehabilitation and training system, the upper-limb rehabilitation device comprises: a second arm segment robotic arm having one end thereof connected to the upper arm positioning-lifting rotary member and an opposite end thereof terminating in an elbow twist rotary member, wherein the second an segment robotic arm comprises an upper arm length adjuster set between the upper arm positioning-lifting rotary member and the elbow twist rotary member for adjusting the length of the second arm segment robotic arm; an elbow joint positioning link having one end thereof terminating in an upper arm link and an opposite end thereof terminating in a forearm link, the upper arm link being connectable to the elbow twist rotary member of the second arm segment robotic arm; a third arm segment robotic arm having one end thereof terminating in a forearm lifting rotary member and an opposite end thereof terminating in a wrist twist rotary member, wherein the third arm segment robotic arm comprises a forearm length adjuster set between the forearm lifting rotary member and the wrist twist rotary member for adjusting the length of the third arm segment robotic arm, the forearm lifting rotary member being connectable to the forearm link of the elbow joint positioning link; and a palm rehabilitation device or a hand grip connected to the wrist twist rotary member of the third arm segment robotic arm.

In one embodiment of the limb rehabilitation and training system, the elbow joint positioning link comprises at least one arm holder.

In one embodiment of the limb rehabilitation and training system, the upper arm link is mounted at the arm holder, and the elbow twist rotary member of the second arm segment robotic arm is linked to the upper arm link.

In one embodiment of the limb rehabilitation and training system, the upper arm link and the arm holder are made in one piece, and the elbow twist rotary member of the second arm segment robotic arm is linked to the arm holder.

In one embodiment of the limb rehabilitation and training system, further comprises at least one localized video recorder selectively mounted at the height adjuster, the shoulder joint traction mechanism or the upper-limb rehabilitation device.

In one embodiment of the limb rehabilitation and training system, further comprises at least one joint positioning guard, each the joint positioning guard comprising at least one position sensing point sensible by the at least one localized video recorder or a control system to form a component position data.

In one embodiment of the limb rehabilitation and training system, the joint positioning guard comprises at least a shoulder joint positioning guard, an elbow joint positioning guard, or a wrist joint positioning guard.

In one embodiment of the limb rehabilitation and training system, further comprises a control system electrically connected to the traction displacement member and adapted to control movement of the traction displacement member.

In one embodiment of the limb rehabilitation and training system, the control system has stored therein at least one control data or at least one rehabilitation data, the control system comprising at least one potentiometer, at least one force sensor and at least one actuator, the at least one potentiometer and the at least one force sensor and the at least one actuator being selectively mounted in the first arm segment robotic arm, the height adjuster, the shoulder positioning-lifting rotary member, the upper arm positioning-lifting rotary member or the upper-limb rehabilitation device.

In one embodiment of the limb rehabilitation and training system, the upper-limb rehabilitation device is adjustable to fit the left arm or right arm subject to the operation of the horizontal positioning slide, the expansion rotary member, the shoulder positioning-lifting rotary member or the upper arm positioning-lifting rotary member.

In one embodiment of the limb rehabilitation and training system, the height adjuster comprises a shoulder joint traction positioning guide selectively mounted at an extended location or back side of the height positioning slide, and the upper arm positioning-lifting rotary member of the upper-limb rehabilitation device is linked to the shoulder joint traction positioning guide so that the upper arm positioning-lifting rotary member is movable or rotatable on the shoulder joint traction positioning guide.

In one embodiment of the limb rehabilitation and training system, the upper-limb rehabilitation device comprises: a second arm segment robotic arm having one end thereof terminating in the upper arm positioning-lifting rotary member and an opposite end thereof providing an elbow twist rotary member, wherein the second arm segment robotic arm comprises an upper arm length adjuster set betweens aid upper arm positioning-lifting rotary member and the elbow twist rotary member and adapted for adjusting the length of the second arm segment robotic arm, an elbow joint positioning link having one end thereof providing an upper arm link and an opposite end thereof providing a forearm link, the upper arm link being linkable to the elbow twist rotary member of the second arm segment robotic arm; a third arm segment robotic arm having one end thereof terminating in a forearm lifting rotary member and an opposite end thereof terminating in a wrist twist rotary member, wherein the third arm segment robotic arm comprises a forearm length adjuster set betweens aid forearm lifting rotary member and the wrist twist rotary member and adapted to adjust the length of the third arm segment robotic arm, the forearm lifting rotary member being linkable to the forearm link of the elbow joint positioning link; and a palm rehabilitation device or hand grip linked to the wrist twist rotary member of the third arm segment robotic arm.

In one embodiment of the limb rehabilitation and training system, further comprises at least one localized video recorder selectively mounted at the height adjuster or the upper-limb rehabilitation device.

Other advantages and features of the present invention will be fully understood by reference to the following specification in conjunction with the accompanying drawings, in which like reference signs denote like components of structure.

DETAILED DESCRIPTION OF THE PREFERRED EMBODIMENTS

Figure 1:
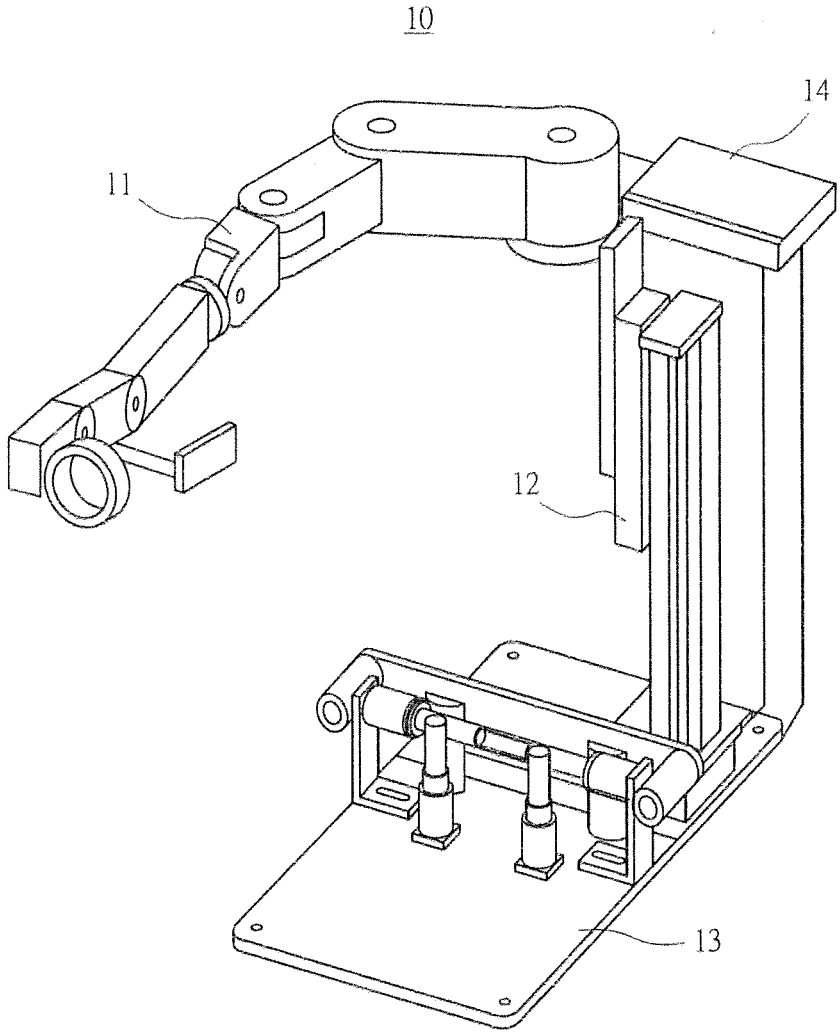
FIG.1 (PRIOR ART)
FIG. 1 is a schematic top elevational view of a limb rehabilitation and training system according to the prior art.
Figure 2:
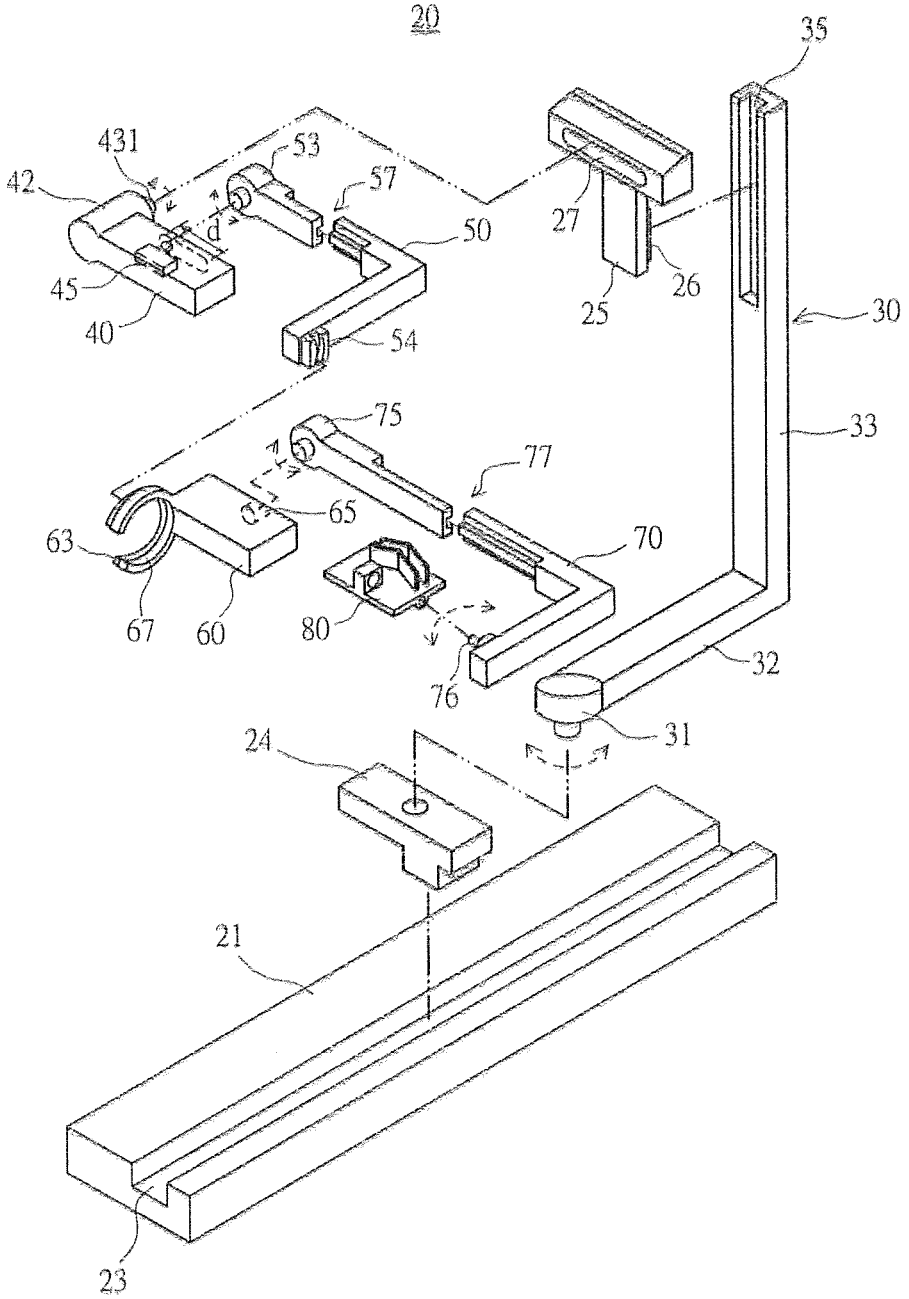
FIG. 2 is an exploded view of a limb rehabilitation and training system in accordance with the present invention.
Figure 3:
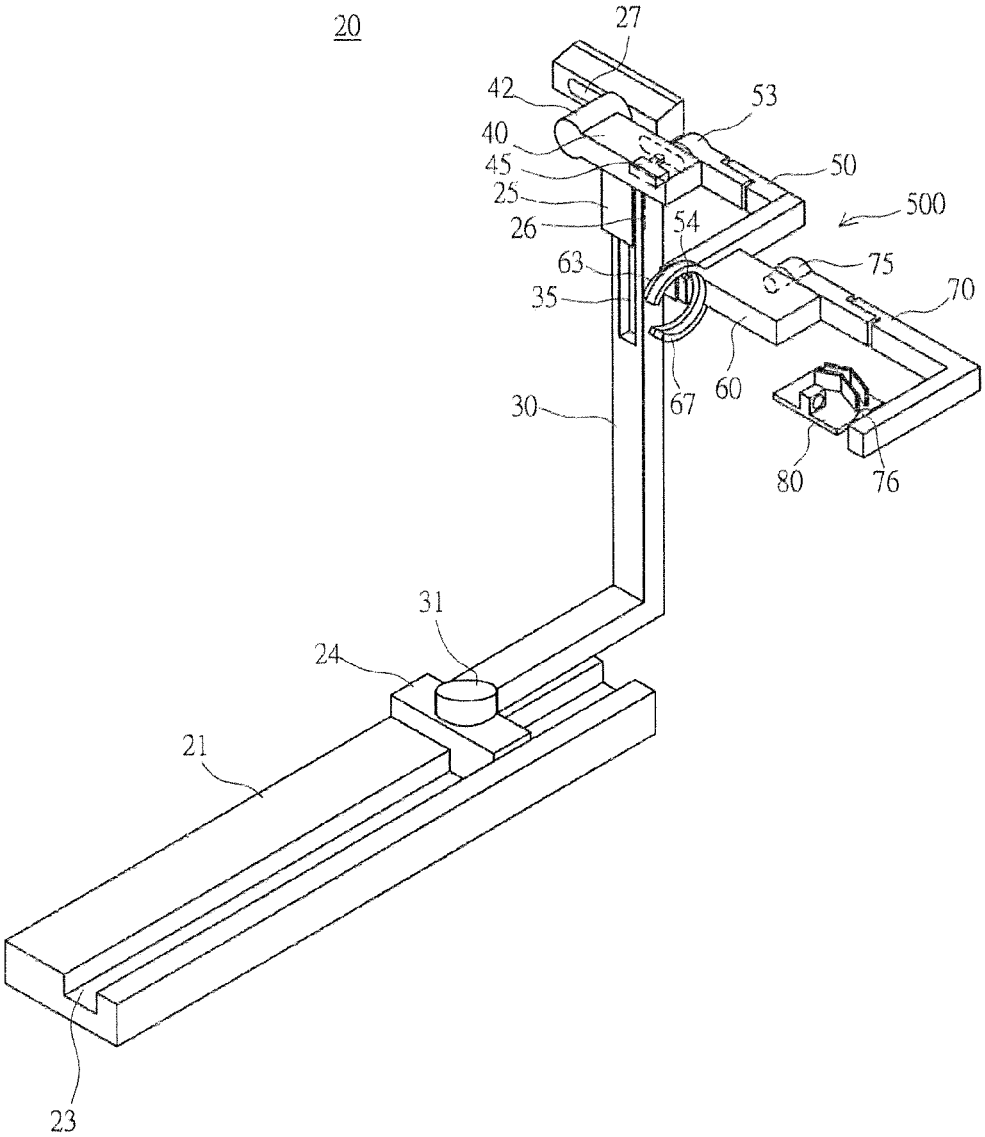
FIG. 3 is a schematic perspective assembly view of the limb rehabilitation and training system in accordance with the present invention.

Please referring to FIGS. 2 and 3, a limb rehabilitation and training system in accordance with the present invention is shown. As illustrated, the limb rehabilitation and training system 20 comprises a horizontal position adjuster 21, a first arm segment robotic arm 30, a height adjuster 25, a shoulder joint traction mechanism 40, and an upper-limb rehabilitation mechanism 500.

The horizontal position adjuster 21 comprises a horizontal linear guide 23, a horizontal positioning slide 24 mounted on (coupled to) the horizontal linear guide 23 and horizontally movable left and right on the horizontal linear guide 23.

The first arm segment robotic arm 30 comprises a horizontal bar 32 and a vertical bar 33. The horizontal bar 32 has its one end connected to the vertical bar 33, and its other end provided with an expansion rotary member 31 for enabling the user to perform shoulder expansion and/or contraction exercises. The expansion rotary member 31 can be mounted on the horizontal positioning slide 24, enabling the first arm segment robotic arm 30 to be moved with the horizontal positioning slide 24 horizontally leftward and rightwards on the horizontal linear guide 23 or rotated horizontally back and forth relative to the horizontal positioning slide 24 to expand or contract the user's shoulder. Further, the vertical bar 33 provides a vertical linear guide 35.

The height adjuster 25 comprises a height positioning slide 26, and a shoulder traction positioning guide 27 mounted at an extended location or back side of the height positioning slide 26. The height positioning slide 26 can be mounted at the vertical linear guide 35 of the first arm segment robotic arm 30, enabling the elevation of the shoulder traction positioning guide 27 of the height adjuster 25 to be adjusted subject to the user's body height.

The shoulder joint traction mechanism 40 comprises a shoulder positioning-lifting rotary member 42 connected to the height adjuster 25 for enabling the position of the user's shoulder to be adjusted forward and backward, lifted and rotated. The shoulder positioning-lifting rotary member 42 is mounted at the shoulder traction positioning guide 27 of the height adjuster 25 for allowing forward/backward adjustment of the position of the shoulder joint traction mechanism 40 within the movable range of the shoulder joint traction positioning guide 27 subject to the accurate position of the user's shoulder, shoulder joint and/or the sliding center of the shoulder joint after the user sits down or stands up.

The shoulder joint traction mechanism 40 comprises a traction displacement member 45 therein that can be linked to a upper arm positioning-lifting rotary member 53 of the upper-limb rehabilitation device 500 and carry it to move on the shoulder joint traction mechanism 40 for a separation distance d.

The traction displacement member 45 can be a traction displacement actuator or traction displacement manual manipulator. If the traction displacement member 45 is a traction displacement actuator, the upper arm positioning-lifting rotary member 53 will be controlled by a control system to perform "passive mode" displacement. On the contrary, if the traction displacement member 45 is a traction displacement manual manipulator, the upper arm positioning-lifting rotary member 53 will be manually assisted or controlled to perform "active mode" displacement.

In the successive rehabilitation or training process after the user positioned or adjusted the horizontal position adjuster 21, the height adjuster 25, the shoulder joint traction mechanism 40 and the upper-limb rehabilitation device 500, the traction displacement member 45 will carry the upper arm positioning-lifting rotary member 53 to move in the shoulder joint traction mechanism 40 for a separation distance d, or to rotate. Displacement or rotation of the upper arm positioning-lifting rotary member 53 involves shoulder joint distraction, compression or gliding, achieving joint mobilization and/or joint loosening effects, and thus this operation not only can fully loosen the user's stiffened shoulder joint, but also is conducive to the subsequent rehabilitation treatment and/or training.

In one embodiment of the present invention, the shoulder positioning-lifting rotary member 42 of the shoulder joint traction mechanism 40 not only allows adjustment of the position of the shoulder joint traction mechanism 40 relative to the height adjuster 25 but also allows performing a rotating operation of lifting up and down in a fixed position on the shoulder joint traction positioning guide 27. The shoulder joint traction mechanism 40 and the linked upper-limb rehabilitation device 500 will follow up the rotary motion of the shoulder positioning-lifting rotary member 42 to perform the rehabilitation actions of lifting up and down.

The linked upper-limb rehabilitation device 500 comprises an upper arm positioning-lifting rotary member 53 that can be linked to a simple support (not shown), or a multi-axis robotic arm as illustrated in the drawings. The multi-axis robotic arm comprises a second arm segment robotic arm 50, an elbow joint positioning link 60, a third arm segment robotic arm 70 and/or a palm rehabilitation device 80.

The second arm segment robotic arm 50 can be made, as illustrated, having an L-shaped structure. However, this L-shaped design is not a limitation. Further, the second arm segment robotic arm 50 comprises an upper arm length adjuster 57 for allowing adjustment of the length of the robotic arm subject to the length of the user's upper arm.

The upper arm positioning-lifting rotary member 53 is adapted to connect the one side of the second arm segment robotic arm 50 and connectable to the traction displacement member 45 of the shoulder joint traction mechanism 40 and movable with the traction displacement member 45 back and forth on the shoulder joint traction mechanism 40 for a separation distance d or lockable at a predetermined position. Thus, the invention not only can use a fixed position of the traction displacement member 45 as a reference point to drive the upper-limb rehabilitation device 500 and the user's shoulder joint/arm in performing the rehabilitation actions of up and down lifting rotation, but also allows forward or backward movement of the upper-limb rehabilitation device 500 for a separation distance d to drag the user's shoulder joint and to further achieve shoulder joint loosening effects subject to the assistance of the traction displacement member 45 and/or physical therapist.

An elbow twist rotary member 54 is mounted at an opposite side of the second arm segment robotic arm 50. The elbow twist rotary member 54 can be made in the form of, but not limited to, a protruding sliding block defining a guide rail or sliding groove. Alternatively, the guide rail or sliding groove can be directly made on the second arm segment robotic arm 50, eliminating the protruding sliding block.

The elbow twist rotary member 54 is adapted to connect the elbow joint positioning link 60 and to drive the upper-limb rehabilitation device 500 and the user's limbs to perform rehabilitation actions of inward and outward twisting.

The elbow joint positioning link 60 has its one end mounted with an upper arm link 63, which is adapted to connect the elbow twist rotary member 54 of the second arm segment robotic arm 50, and an arm holder 67, and its other end mounted with a forearm link 65 for connecting and holding down a forearm lifting rotary member 75 of the third arm segment robotic arm 70.

The arm holder 67 can be made in the form of, but not limited to, the illustrated C-shaped holder member for surrounding the user's arm. Alternatively, the arm holder 67 can be made in the form of a C-type motion guide or O-shaped holder member. During the rehabilitation or training process, the arm holder 67 provides a place for the resting or positioning of the user's arm along the axis of movement.

Preferably, the upper arm link 63 is mounted at the arm holder 67. The upper arm link 63 corresponds to the elbow twist rotary member 54, and can be made in the form of a guide rail or sliding groove. The upper arm link 63 and the elbow twist rotary member 54 can be joined together. Thus, the elbow joint positioning link 60, the third arm segment robotic arm 70 and/or the palm rehabilitation device 80 can achieve the rehabilitation actions of inward and outward twisting subject to the relative positioning relationship between the upper arm link 63 and the elbow twist rotary member 54.

Alternatively, the upper arm link 63 can be a component of the arm holder 67, i.e., the upper arm link 63 can be formed integral with the arm holder 67, and the elbow twist rotary member 54 can be directly connected to the arm holder 67.

The structure of the third arm segment robotic arm 70 is substantially similar to the structure of the second arm segment robotic arm 50. For example, the third arm segment robotic arm 70 can be made, as illustrated, having an L-shaped structure. However, this L-shaped design is not a limitation. Further, the third arm segment robotic arm 70 comprises a forearm length adjuster 77 for allowing adjustment of the length of the robotic arm subject to the length of the user's forearm.

The forearm lifting rotary member 75 is mounted at one end of the third arm segment robotic arm 70 and connected to the forearm link 65 of the elbow joint positioning link 60. Based on the reference point at the forearm link 65, the forearm lifting rotary member 75 can be moved to drive the third arm segment robotic arm 70 and the user's forearm and/or palm in performing the rehabilitation actions of up and down lifting rotation.

The third arm segment robotic arm 70 has its other end mounted with a wrist twist rotary member 76 for connecting the palm rehabilitation device 80 and driving the palm rehabilitation device 80 and the user's palm, wrist and/or forearm to perform the rehabilitation or training actions of inward and outward twisting.

Linking the wrist twist rotary member 76 and the palm rehabilitation device 80 not only can hold the user's palm in place but also can rehabilitate or train the functions of the user's palm.

Figure 4:
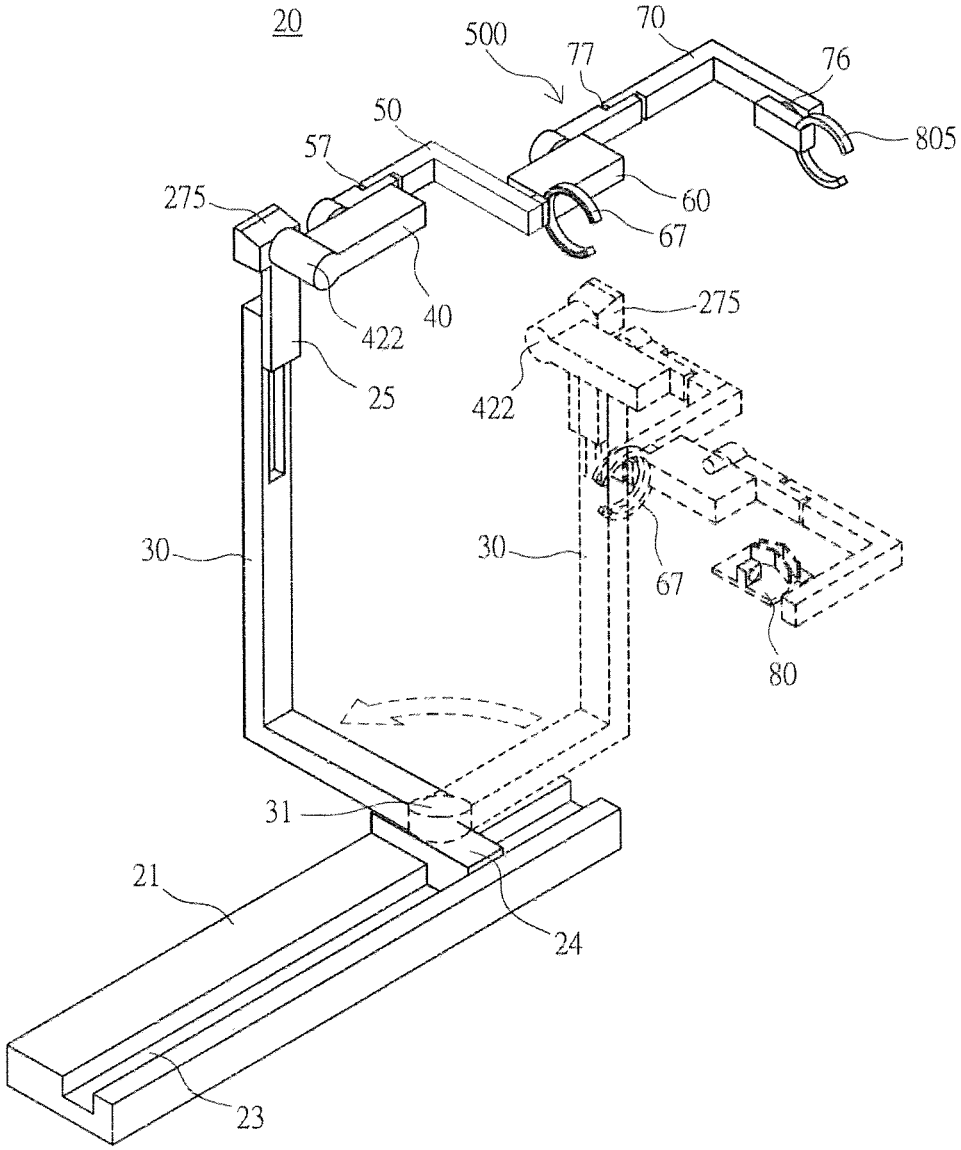
FIG. 4 is a schematic drawing illustrating an operation status of the limb rehabilitation and training system in accordance with the present invention.

Referring to FIG. 4, an alternate form of the limb rehabilitation and training system of the present invention is illustrated. If a user wishes to use the limb rehabilitation and training system for exercising shoulder rehabilitation or training actions of outward expansion or inward contraction, insert the arm through the arm holder 67, and then adjust the relative lengths of the upper arm length adjuster 57 and the forearm length adjuster 77, and then put the palm in the palm rehabilitation device 80 or on a hand grip 805, and then select "passive mode" for allowing the control system to control the operation. Thus, the limb rehabilitation and training system 20 can be driven to directly move the user's arm horizontally.

Alternatively, the user can select "active mode". At this time, the user can apply force to move the limb rehabilitation and training system 20 directly or under the physiatrist, forcing the first arm segment robotic arm 30 to move the height adjuster 25, the shoulder joint traction mechanism 40, the upper-limb rehabilitation device 500, the hand grip 805 and the user's shoulder/arm horizontally leftward and rightward on the reference point of fixed location of the expansion rotary member 31, thereby achieving outward expansion or inward contraction of the shoulder.

Further, in another embodiment of the present invention, the height adjuster 25 is equipped with a shoulder joint stretching link 275 to substitute for the shoulder joint traction positioning guide 27; instead of the shoulder positioning-lifting rotary member 42, the shoulder joint traction mechanism 40 uses a shoulder positioning member 422 for fixation to the shoulder joint stretching link 275. Before operating the limb rehabilitation and training system 20, the horizontal position adjuster 21 and the height adjuster 25 are relatively adjusted subject to the accurate position of the user's shoulder or shoulder joint, or the sliding center of the user's shoulder joint when the user stands up or sits down.

The shoulder joint stretching link 275 can be, but not limited to, a locating hole, and the shoulder positioning member 422 can be a mating protruding member. On the contrary, the shoulder positioning member 422 can be a locating hole, and the shoulder joint stretching link 275 can be a mating protruding member.

Because the component parts of the limb rehabilitation and training system 20 are kept away from the user's head and the back of the user's head during operation of the limb rehabilitation and training system 20 to perform a rehabilitation process of shoulder expansion or contraction, the invention greatly reduces the risk of accidental head injury and effectively help the user from feeling oppressed when using the limb rehabilitation and training system 20, thereby increasing user's interest in using the limb rehabilitation and training system 20 and enhancing the rehabilitation effects of the limb rehabilitation and training system 20.

In still another embodiment of the present invention, the wrist twist rotary member 76 is directly connected with a hand grip 805 to substitute for the aforesaid palm rehabilitation device 80 for holding or supporting the user's palm.

Figure 5:
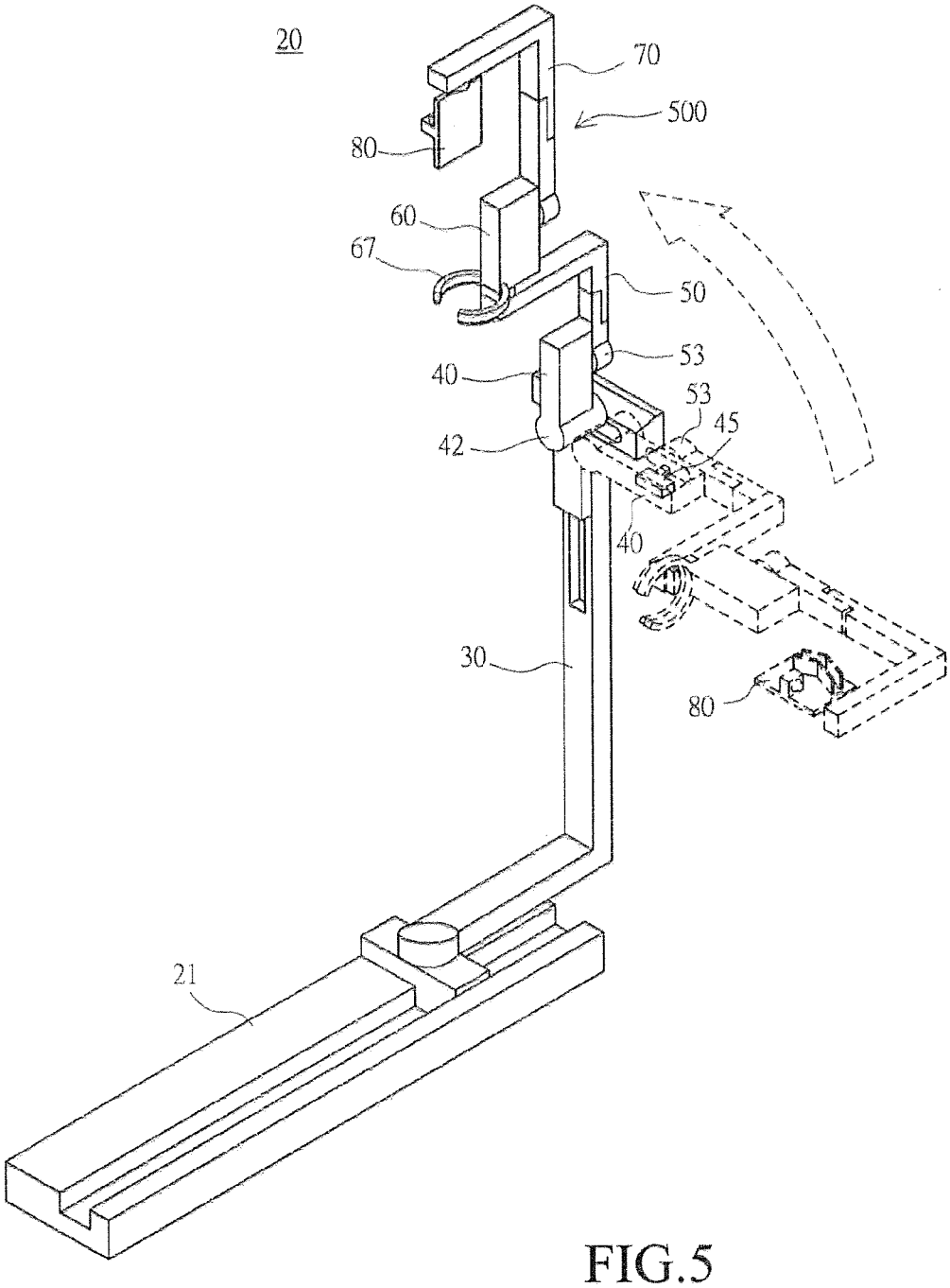
FIG. 5 is a schematic drawing illustrating another operation status of the limb rehabilitation and training system in accordance with the present invention.

Referring to FIG. 5, a status of use of the limb rehabilitation and training system in accordance with the present invention is shown. When a user wishes to perform the rehabilitation or training actions of shoulder or arm bobbing or lifting, insert the arm through the arm holder 67, and then rest the palm on the palm rehabilitation device 80, and then select the "passive mode" for enabling the control system to control the operation of the system, or the "active mode" to let the system be operated by the user, and then select the shoulder positioning-lifting rotary member 42 of the shoulder joint traction mechanism 40 or the upper arm positioning-lifting rotary member 53 of the second arm segment robotic arm 50 as a reference point for rotary motion, and thus the upper-limb rehabilitation device 500 and the user arm can be moved up and down, achieving the rehabilitation or training operation of shoulder or arm lifting.

In one embodiment of the present invention, during the operation of moving the upper-limb rehabilitation device 500 and the user's arm up and down, the traction displacement member 45 of the shoulder joint traction mechanism 40 will also move the upper-limb rehabilitation device 500 and the user arm transiently forward or backward for a separation distance d to loosen or stretch the user's shoulder joint.

Figure 6:
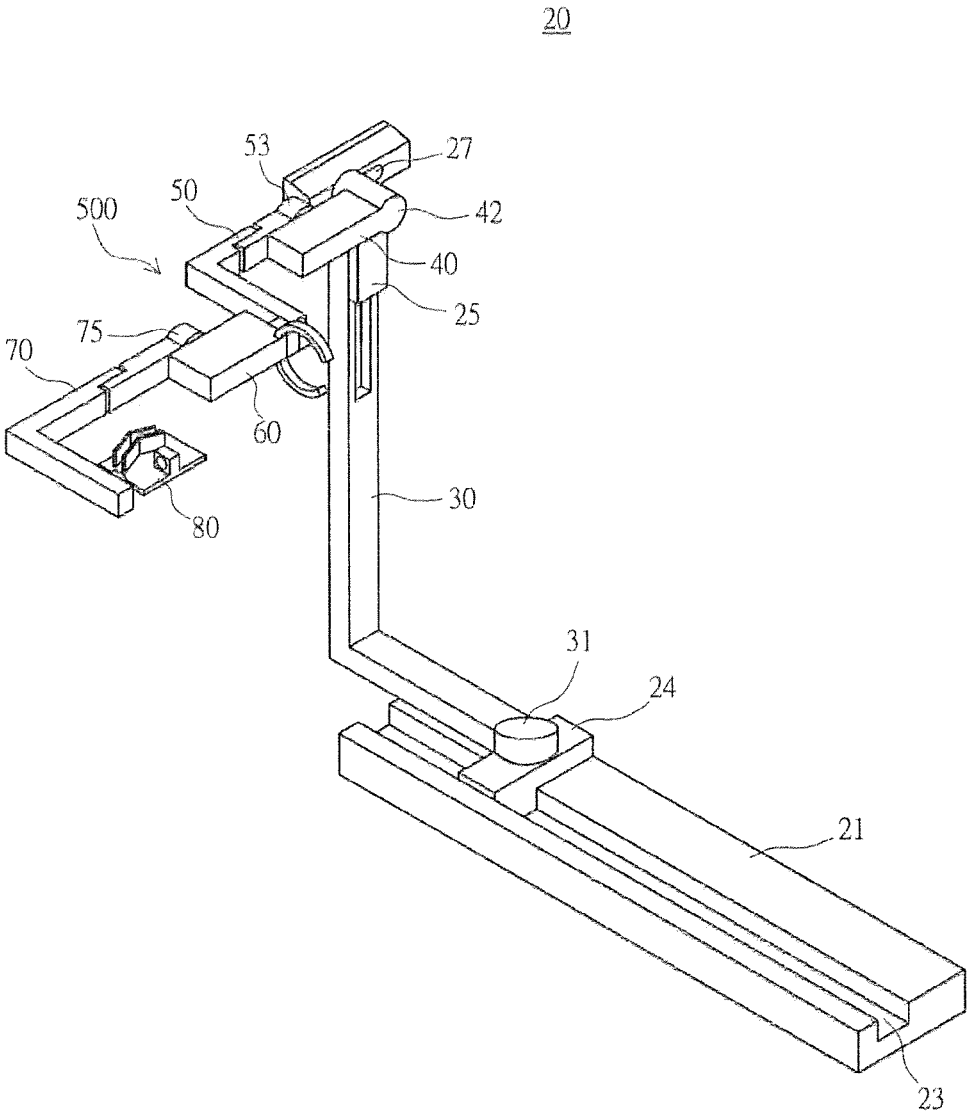
FIG. 6 is a schematic drawing illustrating another operation status of the limb rehabilitation and training system in accordance with the present invention.

Referring to FIG. 6, another status of use of the limb rehabilitation and training system in accordance with the present invention is shown. On the same machine and/or system, the limb rehabilitation and training system 20 can be quickly changed and adjusted for left arm or right arm rehabilitation or training. The rehabilitation and training system as illustrated in the aforesaid drawings is configured for exercising the user's left arm. When going to perform a right arm rehabilitation or training process, the horizontal positioning slide 24 can be moved toward the center area of the horizontal linear guide 23, or the other side, i.e., the left side of the horizontal linear guide 23, subject to the setting of "passive mode" or "active mode" of the system.

Thereafter, based on the reference point at the expansion rotary member 31, the first arm segment robotic arm 30, the height adjuster 25 and the upper-limb rehabilitation device 500 are rotated horizontally outward at an angle of 180-degrees, and then rotated vertically at an angle of 180 degrees on the reference point of the shoulder positioning-lifting rotary member 42 of the shoulder joint traction mechanism 40, or the shoulder positioning member 422, or the upper arm positioning-lifting rotary member 53 of the upper-limb rehabilitation device 500. Thus, the first arm segment robotic arm 30, the height adjuster 25, the shoulder joint traction mechanism 40 and the upper-limb rehabilitation device 500 are changed into a rehabilitation and training system for exercising the user or patient's right arm.

Because the invention allows one same system to be easily and rapidly changed for treating the left arm or right arm in response to the actual needs of the user, the invention greatly increases the efficiency of use of the limb rehabilitation and training system, reducing material waste generated during manufacturing.

Figure 7:
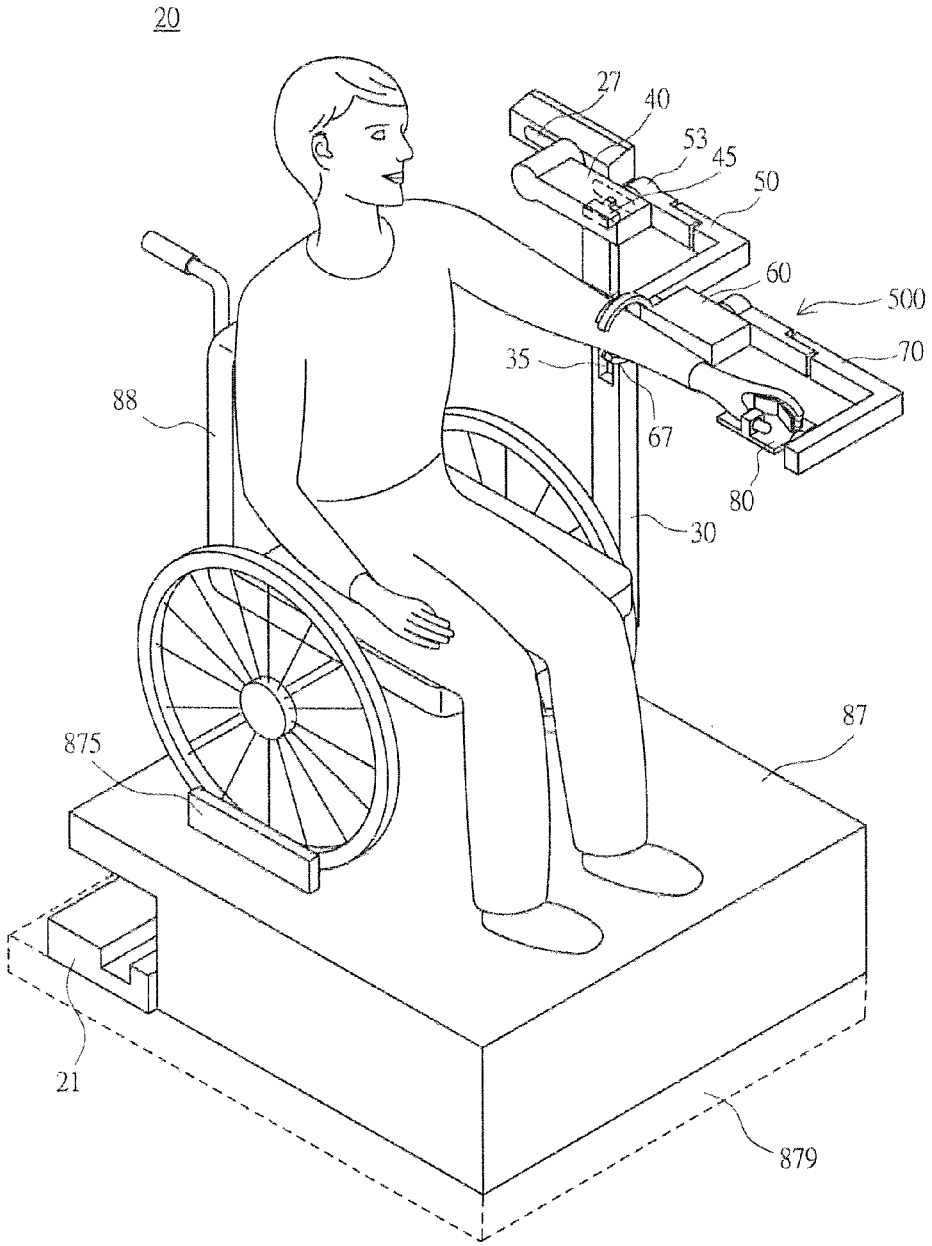
FIG. 7 is a schematic drawing illustrating another operation status of the limb rehabilitation and training system in accordance with the present invention.

Referring to FIG. 7, still another alternate form of the limb rehabilitation and training system in accordance with the present invention is shown. As illustrated, the invention further comprises a movable base 87 placed on an extended location at the top side of the horizontal position adjuster 21, and a wheelchair holder 875 mounted on the movable base 87 for securing a chair or wheelchair 88 for the sitting of a patient or user.

Referring to FIG. 7 and FIGS. 3 and 4, after the user and the wheelchair 88 carrying the user are positioned on the horizontal position adjuster 21 and/or movable base 87, adjust the position of the horizontal positioning slide 24 at the horizontal linear guide 23 to adjust the best horizontal distance (X axis) between the shoulder joint traction mechanism 40 and upper-limb rehabilitation device 500 and the user, and then adjust the optimal height (Y axis) of the shoulder joint traction mechanism 40 and the upper-limb rehabilitation device 500 by means of adjusting the position of the height positioning slide 26 at the vertical linear guide 35, and then adjust the accurate position (Z axis) of the upper-limb rehabilitation device 500 relative to the user's shoulder joint or shoulder by means of adjusting the position of the shoulder positioning-lifting rotary member 42 (or shoulder positioning member 422) of the shoulder joint traction mechanism 40 at the shoulder joint traction positioning guide 27, and then adjust the upper-limb rehabilitation device 500 to fit the length of the user's arm and to fix the relative position or gap of the user's shoulder, elbow joint and wrist joint by means of adjusting the length of the upper arm length adjuster 57 and the length of the forearm length adjuster 77.

By means of relative position adjustment of the aforesaid component parts, the limb rehabilitation and training system is configured to fit the body size of every different user, reducing the risk of accidental secondary injury during rehabilitation.

Further, in one embodiment of the present invention, a bearing platform 879 is provided at the bottom side of the movable base 87 to carry the horizontal position adjuster 21. Thus, by means of moving the movable base 87, the limb rehabilitation and training system 20 can be transferred to the desired place, facilitating a user or patient to use the system.

Figure 8:
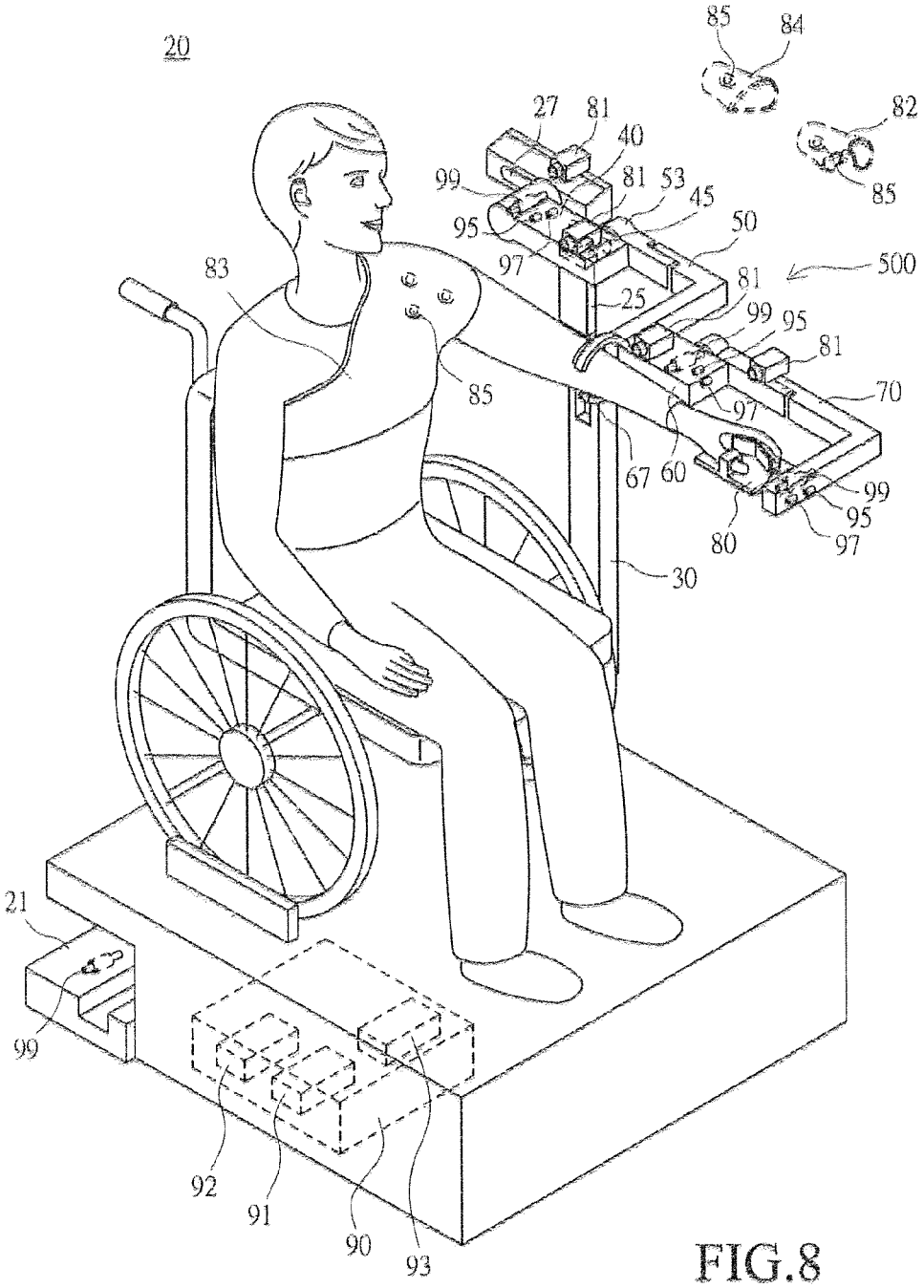
FIG. 8 is a schematic drawing illustrating still another operation status of the limb rehabilitation and training system in accordance with the present invention.

Further, FIG. 8 illustrates still another alternate form of the present invention. As illustrated, the limb rehabilitation and training system 20 in this embodiment further comprises a control system 90 having stored therein recorded control data 91 of the component parts of the limb rehabilitation and training system 20 and/or rehabilitation data 92 of the user.

To accurately adjust the optimal position of every component part of the limb rehabilitation and training system 20, the adjustment operation can be done by a physiatrist, physical therapist, medical personnel or trainer. However, in some special occasions, it may be unable to find a professional therapist to adjust the machine. The invention eliminates this problem by providing one or multiple localized video recorders 81 selectively mounted at the height adjuster 25, the shoulder joint traction mechanism 40, the elbow joint positioning link 60 and/or the upper-limb rehabilitation device 500 for picking up every important part of the user's arm and transmitting fetched video data to the control system 90, which calculates the video data to find out the optimal component position data 93 of every component part of the limb rehabilitation and training system 20.

Of course, the component position data 93 can be obtained subject to the rehabilitation plan or body size of the individual user arranged or measured by a physiatrist, physical therapist, medical personnel or trainer.

The component position data 93, control data 91 and/or rehabilitation data 92 can be displayed on a display screen (not shown), and the user or assistant can use this data to adjust the best configuration of the limb rehabilitation and training system 20 for the user.

Further, in still another alternate form of the present invention, as shown in FIG. 3 and FIG. 8, one or multiple actuators 99 are installed in the horizontal position adjuster 21 of the limb rehabilitation and training system 20, the expansion rotary member 31, the height adjuster 25, the shoulder joint traction mechanism 40, the shoulder positioning-lifting rotary member 42, the upper arm positioning-lifting rotary member 53, the elbow twist rotary member 54, the forearm lifting rotary member 75 and/or the wrist twist rotary member 76. These actuators 99 are electrically connected to and controlled by the control system 90. The control system 90 controls on/off of every actuator 99 subject to the component position data 93, moving every component part of the limb rehabilitation and training system 20 to the respective best position at the same time point.

Further, in order to prevent accidental injury of the shoulder joint, elbow joint and/or wrist joint during a rehabilitation operation, the invention provides one or multiple joint positioning guards, for example, a shoulder joint positioning guard 83, an elbow joint positioning guard 84 and/or a wrist joint positioning guard 82 wearable on the user's shoulder, elbow and/or wrist. Every joint positioning guard 82/83/84 provides one or multiple position sensing points 85 that can be fetched by the localized video recorder 81 and the control system 90 through an optical path, infrared path and/or wireless signal transmission path for figuring out the location of the user's shoulder and every part or joint of the user's arm and the desired component position data 93. Thus, the invention greatly shortens the adjustment time of the limb rehabilitation and training system 20 and reduces the risk of accidental rehabilitation injury.

Further, in still another alternate form of the present invention, one or multiple potentiometers 95 and force sensors 97 can be installed in the expansion rotary member 31, the shoulder positioning-lifting rotary member 42 or one or multiple component parts of the upper-limb rehabilitation device 500, and electrically connected to the control system 90.

The potentiometer 95 is adapted to detect the relative adjustment position of the expansion rotary member 31, the shoulder positioning-lifting rotary member 42 or the upper-limb rehabilitation device 500. The force sensor 97 can detect the pressure being applied to the expansion rotary member 31, the shoulder positioning-lifting rotary member 42 or the upper-limb rehabilitation device 500. These detected data are transmitted to the control system 90 for recording, facilitating physiatrist, physical therapist, medical personnel or trainer reference, and thus the physiatrist, physical therapist, medical personnel or trainer can master the rehabilitation or training program and figure out whether or not the user or patient has been well rehabilitated or trained, and then put the user in mind. These detected data could become future rehabilitation data 92 or control data 91.

Figure 9:
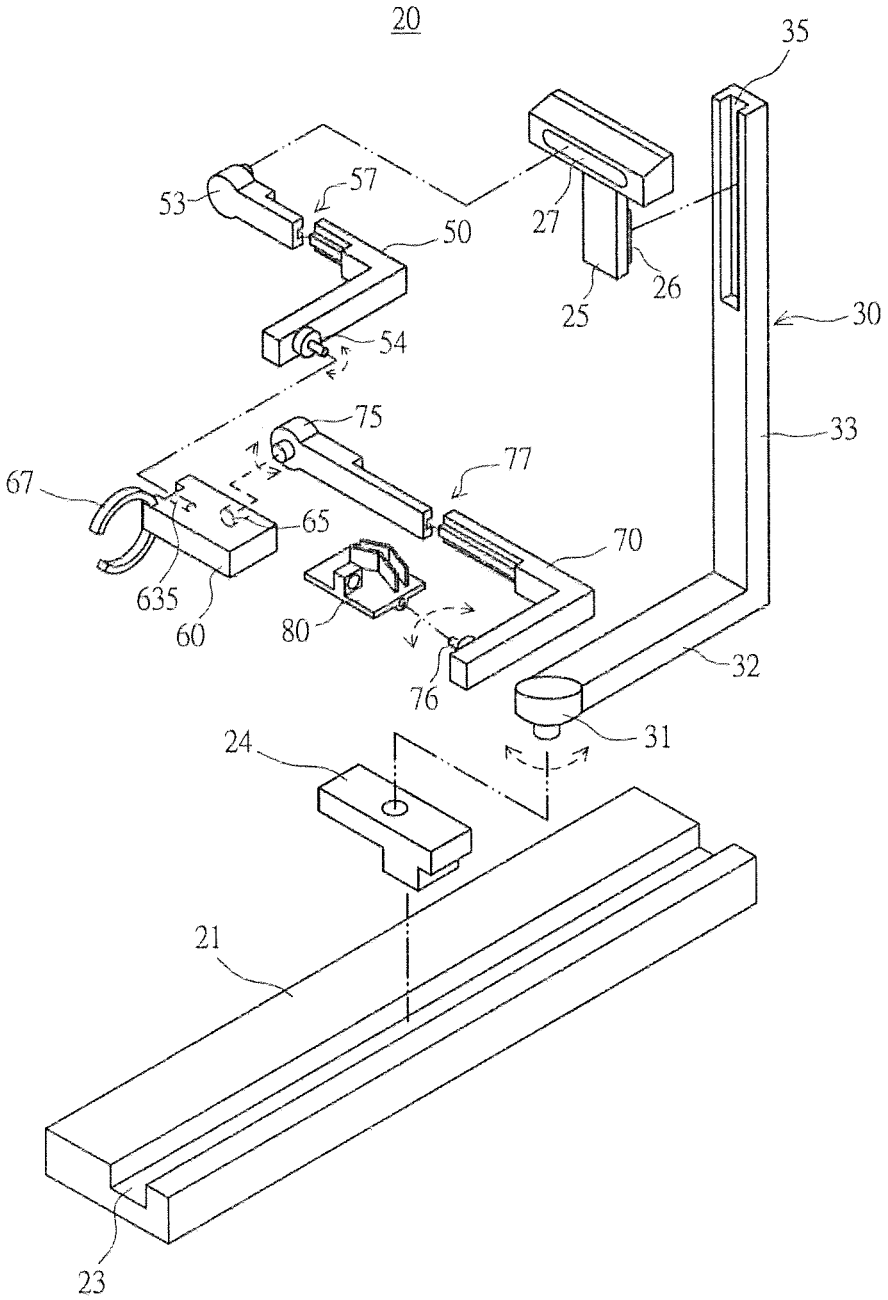
FIG. 9 is a schematic exploded view of still another operation status of the limb rehabilitation and training system in accordance with the present invention.

Finally, see FIG. 9, in still another embodiment of the present invention, the limb rehabilitation and training system comprises a horizontal position adjuster 21, a first arm segment robotic arm 30, a height adjuster 25 and an upper-limb rehabilitation device 500, but without the aforesaid shoulder joint traction mechanism 40, achieving the same effects and allowing quick adjustment to fit for left arm and right arm rehabilitation and training exercises.

Further, in one embodiment of the present invention, the user can directly adjust the standing or sitting position. In this embodiment, the horizontal position adjuster 21 is eliminated, and the first arm segment robotic arm 30 simply has the vertical bar 33 and/or the vertical linear guide 35 left for application. This embodiment eliminates the use of the horizontal position adjuster 21, however subject to the use of the shoulder joint traction mechanism 40 and the upper-limb rehabilitation device 500, the object of loosening or stretching the shoulder joint can still be achieved.

Further, every movable component part 24/26/45, every guide 23/27, the upper arm length adjuster 57, the forearm length adjuster 77, the elbow twist rotary member 54 or the forearm link 65 in the aforesaid embodiments or drawings is made in the form of a sliding block, guide groove, sliding groove or guide rail. However, the use of the aforesaid component parts is not a limitation. Gear, chains, conveyer belt, elastic member, or any other equivalent device can be used as a substitute.

Further, in still another alternate form of the present invention, the elbow twist rotary member 54 can be a protruding member extended from one end of the second arm segment robotic arm 50, and a mating upper arm link 635, for example, a coupling hole can be provided at the front side of the elbow joint positioning link 60 to substitute for the aforesaid guide rail or sliding groove 63 at the arm holder 67. By means of coupling between the elbow twist rotary member 54 and the upper arm link 635, the second arm segment robotic arm 50 and the elbow joint positioning link 60 are connected together, allowing rotation of the elbow joint positioning link 60 and the upper-limb rehabilitation device 500.

In the foresaid embodiments or drawings, the limb rehabilitation and training system is described for exercising the user's upper limb, shoulder joint, elbow or wrist. Actually, the limb rehabilitation and training system can also be used to perform the rehabilitation and training program of exercising the user's lower limb, thigh, knee joint or ankle joint.

In the specification of the present invention, the wordings of may, must and change are not intended to restrict the invention. The terminologies used in the specification are used to describe particular embodiments of the invention, but not intended for use as restrictions. For example, the word of "link", can be "connected together", "sleeved together" or "engaged together" that is understandable to any person skilled in the art who examined the present specification and the annexed drawings. Further, a single quantifier (such as one or the) used in the specification can be multiple unless specifically described in the specification. For example, one device mentioned in the specification can be a combination of multiple devices.

What is claimed is:

1. A limb rehabilitation and training system, comprising:

a first arm segment robotic arm including a vertical bar and a vertical linear guide mounted at said vertical bar;

a height adjuster including a height positioning slide connected to said vertical linear guide of said first arm segment robotic arm to move along said vertical linear guide;

a shoulder joint traction mechanism having one end thereof connected to said height adjuster via a shoulder positioning-lifting rotary member having a shoulder positioning member, wherein said shoulder joint traction mechanism is thereby disposed to be angularly displaceable and linearly displaceable relative to said first arm segment robotic arm, said shoulder joint traction mechanism being linearly displaceable along both a first direction and a second direction transversely oriented in relation to the first direction, said shoulder joint traction mechanism including a traction displacement member; and an upper-limb rehabilitation device including an upper arm positioning-lifting rotary member having one end thereof connected to said traction displacement member, and a simple support or a multi-axis robotic arm connected to an opposite end of said upper arm positioning-lifting rotary member, said upper arm positioning-lifting rotary member being linearly movable by said traction displacement member over a separation distance relative to said shoulder joint traction mechanism.

2. The limb rehabilitation and training system as claimed in claim 1, wherein said traction displacement member is selectively made in the form of a traction displacement actuator or traction displacement manual manipulator.

3. The limb rehabilitation and training system as claimed in claim 1, wherein said height adjuster further includes a shoulder joint traction positioning guide located at an extended location or back side of said height positioning slide for connecting said shoulder positioning-lifting rotary member of said shoulder joint traction mechanism and allowing said shoulder positioning-lifting rotary member to be moved or rotated on said shoulder joint traction positioning guide.

4. The limb rehabilitation and training system as claimed in claim 1, further comprising a horizontal position adjuster including a horizontal linear guide and a horizontal positioning slide linked to said horizontal linear guide;

wherein said first arm segment robotic arm further includes a horizontal bar having one end thereof connected to said vertical bar, and an expansion rotary member mounted at an opposite end of said horizontal bar and connectable to said horizontal positioning slide for enabling said first arm segment robotic arm to be rotated left and right on said horizontal positioning slide.

5. The limb rehabilitation and training system as claimed in claim 3, further comprising a horizontal position adjuster, said horizontal position adjuster including a horizontal linear guide and a horizontal positioning slide linked to said horizontal linear guide;

wherein said first arm segment robotic arm further includes a horizontal bar having one end thereof connected to said vertical bar, and an expansion rotary member mounted at an opposite end of said horizontal bar and connectable to said horizontal positioning slide for enabling said first arm segment robotic arm to be rotated leftward and rightward on said horizontal positioning slide.

6. The limb rehabilitation and training system as claimed in claim 5, wherein said upper-limb rehabilitation device further includes:

a second arm segment robotic arm having one end thereof connected to said upper arm positioning-lifting rotary member and an opposite end thereof terminating in an elbow twist rotary member, said second arm segment robotic arm including an upper arm length adjuster set between said upper arm positioning-lifting rotary member and said elbow twist rotary member, said upper arm length adjuster set adapted for adjusting the length of said second arm segment robotic arm;

an elbow joint positioning link having one end thereof terminating in an upper arm link and an opposite end thereof terminating in a forearm link, said upper arm link being connectable to said elbow twist rotary member of said second arm segment robotic arm, wherein said elbow twist rotary member includes either of a guide rail or a sliding groove and said upper arm link is either a C-shaped holder member or an O-shaped holder member, and said upper arm link being movable along said guide rail or said sliding groove to be coupled to said elbow twist rotary member;

a third arm segment robotic arm having one end thereof terminating in a forearm lifting rotary member and an opposite end thereof terminating in a wrist twist rotary member, said third arm segment robotic arm including a forearm length adjuster set between said forearm lifting rotary member and said wrist twist rotary member, said forearm length adjuster set for adjusting the length of said third arm segment robotic arm, said forearm lifting rotary member being connectable to said forearm link of said elbow joint positioning link; and a palm rehabilitation device or a hand grip connected to said wrist twist rotary member of said third arm segment robotic arm.

7. The limb rehabilitation and training system as claimed in claim 6, wherein said elbow joint positioning link includes at least one arm holder.

8. The limb rehabilitation and training system as claimed in claim 7, wherein said upper arm link is mounted at said arm holder, and said elbow twist rotary member of said second arm segment robotic arm is linked to said upper arm link.

9. The limb rehabilitation and training system as claimed in claim 7, wherein said upper arm link and said arm holder are made in one piece, and said elbow twist rotary member of said second arm segment robotic arm is linked to said arm holder.

10. The limb rehabilitation and training system as claimed in claim 1, further comprising at least one localized video recorder selectively mounted at said height adjuster, said shoulder joint traction mechanism, or said upper-limb rehabilitation device.

11. The limb rehabilitation and training system as claimed in claim 10, further comprising at least one joint positioning guard, each joint positioning guard including at least one position sensing point viewable by said at least one localized video recorder or sensible by a sensor of a control system to form a component position data.

12. The limb rehabilitation and training system as claimed in claim 11, wherein said at least one joint positioning guard is a shoulder joint positioning guard, an elbow joint positioning guard, or a wrist joint positioning guard.

13. The limb rehabilitation and training system as claimed in claim 1, further comprising a control system electrically connected to said traction displacement member and adapted to control movement of said traction displacement member.

14. The limb rehabilitation and training system as claimed in claim 13, wherein said control system has stored therein at least one control data or at least one rehabilitation data, said control system including at least one potentiometer, at least one force sensor, and at least one actuator, said at least one potentiometer and said at least one force sensor and said at least one actuator each selectively mounted in said first arm segment robotic arm, said height adjuster, said shoulder positioning-lifting rotary member, said upper arm positioning-lifting rotary member, or said upper-limb rehabilitation device.

15. The limb rehabilitation and training system as claimed in claim 5, wherein said upper-limb rehabilitation device is adjustable to fit the left arm or right arm subject to the operation of said horizontal positioning slide, said expansion rotary member, said shoulder positioning-lifting rotary member, or said upper arm positioning-lifting rotary member.

16. A limb rehabilitation and training system, comprising:

a horizontal position adjuster including a horizontal linear guide and a horizontal positioning slide linked to said horizontal linear guide;

a first arm segment robotic arm including a horizontal bar and a vertical bar having one end thereof connected to an end of said horizontal bar, a vertical linear guide mounted at an opposite end of said vertical bar, and an expansion rotary member mounted at an opposite end of said horizontal bar, said expansion rotary member being linkable to said horizontal positioning slide for enabling said first arm segment robotic arm to be rotated left and right on said horizontal positioning slide, said horizontal positioning slide enabling linear horizontal displacement of said first arm segment robotic arm relative to said horizontal linear guide;

a height adjuster including a height positioning slide connected to said vertical linear guide of said first arm segment robotic arm; and an upper-limb rehabilitation device including an upper arm positioning-lifting rotary member and a simple support or a multi-axis robotic arm linked to one end of said upper arm positioning-lifting rotary member, said upper arm positioning-lifting rotary member having an opposite end thereof connected to said height adjuster, wherein said upper arm positioning-lifting rotary member is thereby disposed to be angularly displaceable and linearly displaceable relative to said first arm segment robotic arm, said upper arm positioning-lifting rotary member being linearly displaceable along both a first direction and a second direction transversely oriented in relation to the first direction, said upper arm positioning-lifting rotary member being adapted for rotating said simple support or multi-axis robotic arm up and down.

17. The limb rehabilitation and training system as claimed in claim 16, wherein said height adjuster includes a shoulder joint traction positioning guide selectively mounted at an extended location or back side of said height positioning slide, and said upper arm positioning-lifting rotary member of said upper-limb rehabilitation device is linked to said shoulder joint traction positioning guide so that said upper arm positioning-lifting rotary member is movable or rotatable on said shoulder joint traction positioning guide.

18. The limb rehabilitation and training system as claimed in claim 16, wherein said upper-limb rehabilitation device further includes:

a second arm segment robotic arm having one end thereof connected to said upper arm positioning-lifting rotary member and an opposite end thereof providing an elbow twist rotary member, said second arm segment robotic arm including an upper arm length adjuster set between said upper arm positioning-lifting rotary member and said elbow twist rotary member and adapted for adjusting the length of said second arm segment robotic arm;

an elbow joint positioning link having one end thereof providing an upper arm link and an opposite end thereof providing a forearm link, said upper arm link being linkable to said elbow twist rotary member of said second arm segment robotic arm, wherein said elbow twist rotary member includes either of a guide rail or a sliding groove, and said upper arm link being movable along said guide rail or said sliding groove to be coupled to said elbow twist rotary member;

a third arm segment robotic arm having one end thereof terminating in a forearm lifting rotary member and an opposite end thereof terminating in a wrist twist rotary member, wherein said third arm segment robotic arm includes a forearm length adjuster set between said forearm lifting rotary member and said wrist twist rotary member, said forearm length adjuster set adapted for adjusting the length of said third arm segment robotic arm, said forearm lifting rotary member being linkable to said forearm link of said elbow joint positioning link; and a palm rehabilitation device or hand grip linked to said wrist twist rotary member of said third arm segment robotic arm.

19. The limb rehabilitation and training system as claimed in claim 18, wherein said elbow joint positioning link includes at least one arm holder, said arm holder being either one of a C-shaped or O-shaped holder member.

20. The limb rehabilitation and training system as claimed in claim 19, wherein said upper arm link is mounted at said arm holder, and said elbow twist rotary member of said second arm segment robotic arm is linked to said upper arm link.

21. The limb rehabilitation and training system as claimed in claim 19, wherein said upper arm link and said arm holder are made in one piece, and said elbow twist rotary member of said second arm segment robotic arm is linked to said arm holder.

22. The limb rehabilitation and training system as claimed in claim 16, further comprising at least one localized video recorder selectively mounted at said height adjuster, or said upper-limb rehabilitation device.

23. The limb rehabilitation and training system as claimed in claim 22, further comprising at least one joint positioning guard, each joint positioning guard including at least one position sensing point detectable by said at least one localized video recorder or sensible by a sensor of a control system to form a component position data.

24. The limb rehabilitation and training system as claimed in claim 16, further comprising a control system having stored therein at least one control data or at least one rehabilitation data, said control system including at least one potentiometer, at least one force sensor, and at least one actuator, said at least one potentiometer and said at least one force sensor and said at least one actuator each selectively mounted in said first arm segment robotic arm, said height adjuster, or said upper-limb rehabilitation device.

25. The limb rehabilitation and training system as claimed in claim 16, wherein said upper-limb rehabilitation device is adjustable to fit the left arm or right arm subject to the operation of said horizontal positioning slide, said expansion rotary member, or said upper arm positioning-lifting rotary member.

* * * * *